US010312637B2

(12) United States Patent
Chuang

(10) Patent No.: US 10,312,637 B2
(45) Date of Patent: Jun. 4, 2019

(54) ELECTRICAL CONNECTOR HAVING SEAMLESS SHIELDING SHELL AND SINGLE ROW OF CONTACTS

(71) Applicant: FOXCONN INTERCONNECT TECHNOLOGY LIMITED, Grand Cayman (KY)

(72) Inventor: Shun-Jung Chuang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/869,001

(22) Filed: Jan. 11, 2018

(65) Prior Publication Data

US 2018/0198242 A1 Jul. 12, 2018

(30) Foreign Application Priority Data

Jan. 11, 2017 (CN) ..... 2017 2 0030863 U

(51) Int. Cl.

| | |
|---|---|
| ***H01R 13/648*** | (2006.01) |
| ***H01R 13/6585*** | (2011.01) |
| ***H01R 12/70*** | (2011.01) |
| ***H01R 12/71*** | (2011.01) |
| ***H01R 12/73*** | (2011.01) |
| ***H01R 13/6581*** | (2011.01) |
| *H01R 13/20* | (2006.01) |
| *H01R 13/405* | (2006.01) |

(52) U.S. Cl.

CPC ..... *H01R 13/6585* (2013.01); *H01R 12/707* (2013.01); *H01R 12/716* (2013.01); *H01R 12/73* (2013.01); *H01R 13/6581* (2013.01); *H01R 13/20* (2013.01); *H01R 13/405* (2013.01)

(58) Field of Classification Search

CPC . H01R 12/707; H01R 12/716; H01R 13/6585
USPC ..... 439/607.04, 607.01, 74
See application file for complete search history.

(56) References Cited

U.S. PATENT DOCUMENTS 6,042,398 A * 3/2000 Wu ..... H01R 13/655 439/101
6,478,623 B1 * 11/2002 Wu ..... H01R 13/6582 439/607.35
6,923,659 B2 * 8/2005 Zhang ..... H01R 12/716 439/74

(Continued)

FOREIGN PATENT DOCUMENTS

CN 2882007 3/2007
CN 201060978 5/2008

(Continued)

*Primary Examiner* — Abdullah A Riyami
*Assistant Examiner* — Vladimir Imas
(74) *Attorney, Agent, or Firm* — Wei Te Chung; Ming Chieh Chang

(57) ABSTRACT

An electrical connector includes: an insulative housing; a single row of contacts secured to the insulative housing and each having a soldering tail; and a shielding shell enclosing the insulative housing and having an annular part and a pair of soldering portions; wherein the shielding shell annular part is seamless; and the soldering tails of the single row of contacts are arranged alternately in two rows within an outer profile of the shielding shell annular part.

8 Claims, 8 Drawing Sheets

(56) References Cited

U.S. PATENT DOCUMENTS 7,008,267 B2 * 3/2006 Fan ..... H01R 13/658 439/607.35
7,070,423 B2 * 7/2006 Zhang ..... H01R 13/41 439/74
7,074,085 B2 * 7/2006 Chen ..... H01R 13/658 439/607.36
7,168,986 B1 * 1/2007 Peng ..... H01R 12/716 439/607.04
7,758,352 B2 * 7/2010 Zeng ..... H01R 13/26 439/346
7,771,232 B2 * 8/2010 Si ..... H01R 13/658 439/607.01
7,815,467 B2 * 10/2010 Tsuchida ..... H01R 12/716 439/579
8,083,527 B2 * 12/2011 Takeuchi ..... H01R 13/26 439/65
8,105,112 B2 * 1/2012 Midorikawa ..... H01R 13/6582 439/607.35
8,192,231 B2 * 6/2012 De Blieck ..... H01R 13/6582 439/607.04
8,257,114 B2 * 9/2012 Wang ..... H01R 12/57 439/607.01
8,348,701 B1 * 1/2013 Lan ..... H01R 12/707 439/607.19
8,961,215 B2 * 2/2015 Hasegawa ..... H01R 9/091 439/346
8,979,551 B2 * 3/2015 Mongold ..... H01R 12/73 439/74
8,986,027 B2 * 3/2015 Nishimura ..... H01R 12/707 439/181
9,039,428 B2 * 5/2015 Sasaki ..... H01R 12/716 439/74
9,190,752 B1 * 11/2015 Little ..... H01R 12/716
9,425,526 B2 * 8/2016 Uratani ..... H01R 13/6473
9,450,340 B2 9/2016 Uratani et al.
2017/0033505 A1 2/2017 Ozeki

FOREIGN PATENT DOCUMENTS

TW M435072 8/2012
TW 201607179 2/2016

* cited by examiner

ELECTRICAL CONNECTOR HAVING SEAMLESS SHIELDING SHELL AND SINGLE ROW OF CONTACTS

BACKGROUND OF THE INVENTION

1. Field of the Invention

The present invention relates to an electrical connector having a seamless shielding shell and a single row of contacts with soldering tails arranged alternately in two rows within an outer profile of the shielding shell.

2. Description of Related Art

U.S. Pat. No. 9,450,340 discloses an electrical connector having a shielding shell or anchoring terminal that is connected to a ground potential and has a shape that is of substantially rectangular ring with a part thereof cut out. The anchoring terminal is manufactured by bending a single meal plate. Contacts or connection terminals of the electrical connector extend out to an outer side of the substantially rectangular ring via the cut-out portion in the anchoring terminal.

SUMMARY OF THE INVENTION

An electrical connector comprises: an insulative housing; a single row of contacts secured to the insulative housing and each having a soldering tail; and a shielding shell enclosing the insulative housing and having an annular part and a pair of soldering portions; wherein the shielding shell annular part is seamless; and the soldering tails of the single row of contacts are arranged alternately in two rows within an outer profile of the shielding shell annular part.

DETAILED DESCRIPTION OF THE PREFERRED EMBODIMENT

Figure 1:
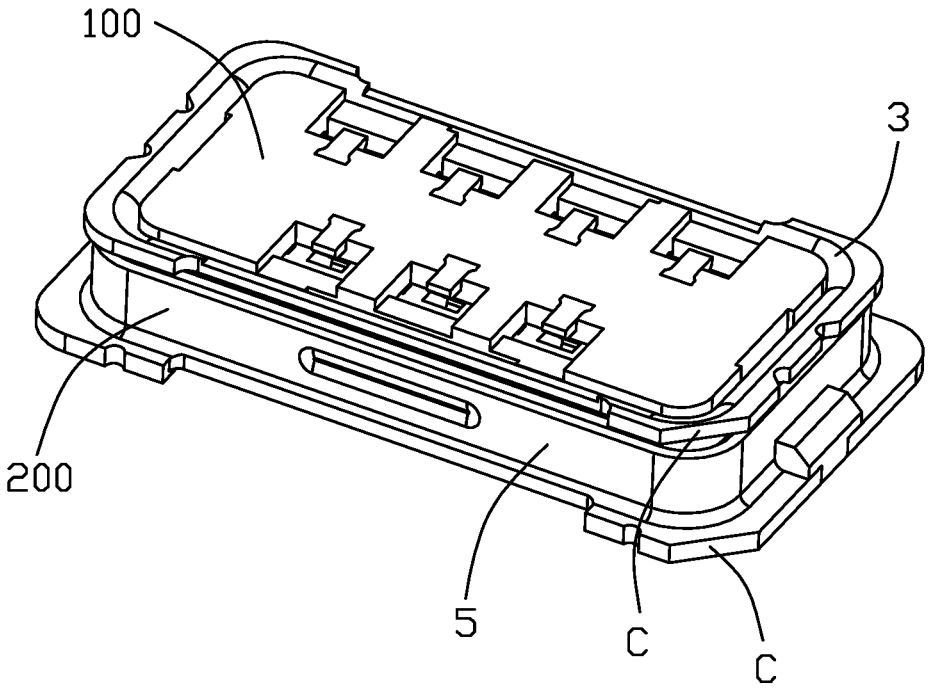
FIG. 1 is a perspective view of an electrical connector assembly in accordance with the present invention.
Figure 2:
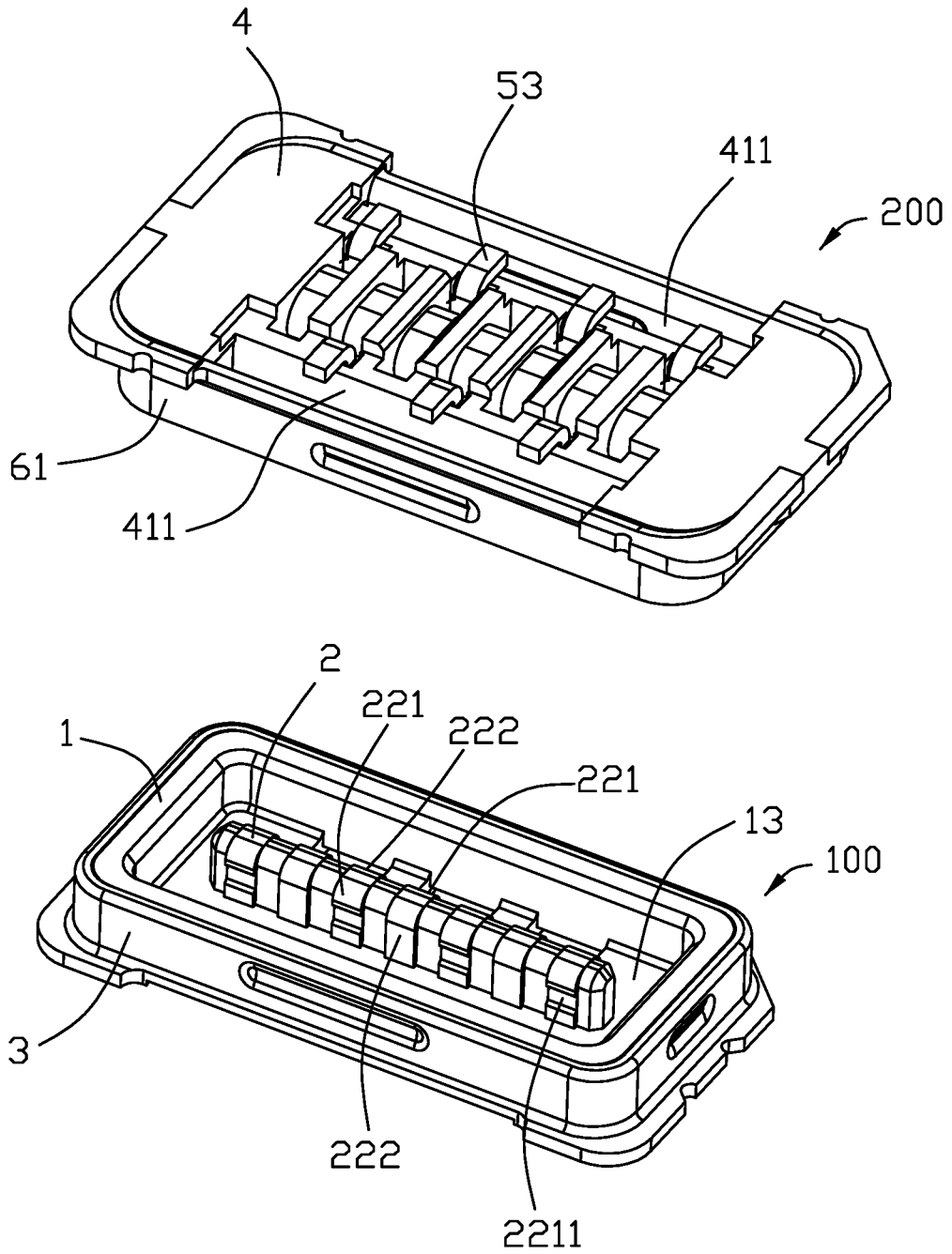
FIG. 2 is a perspective view of a plug connector and a receptacle connector of the electrical connector assembly.
Figure 3:
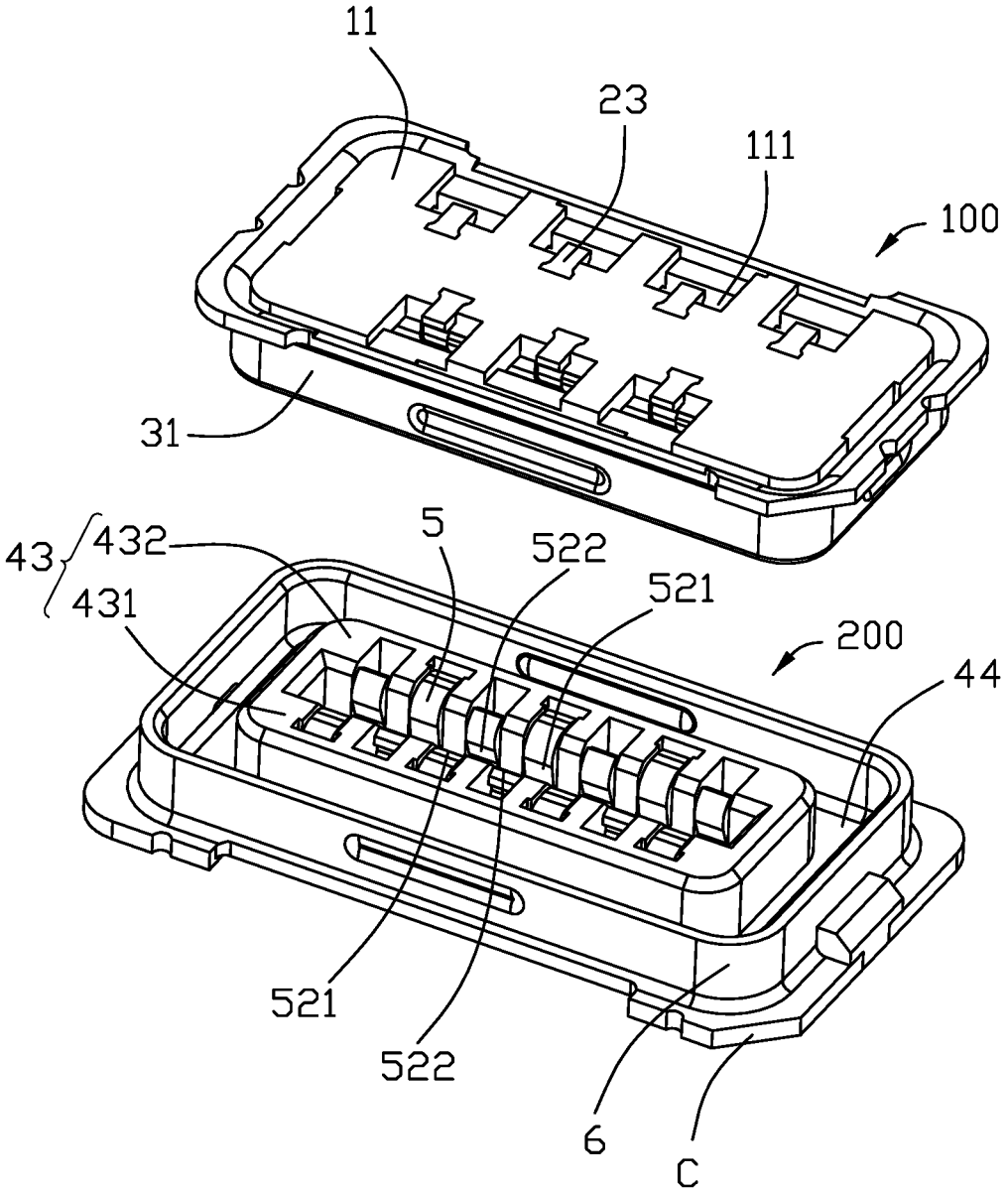
FIG. 3 is another perspective view of the plug connector and the receptacle connector.
Figure 4:
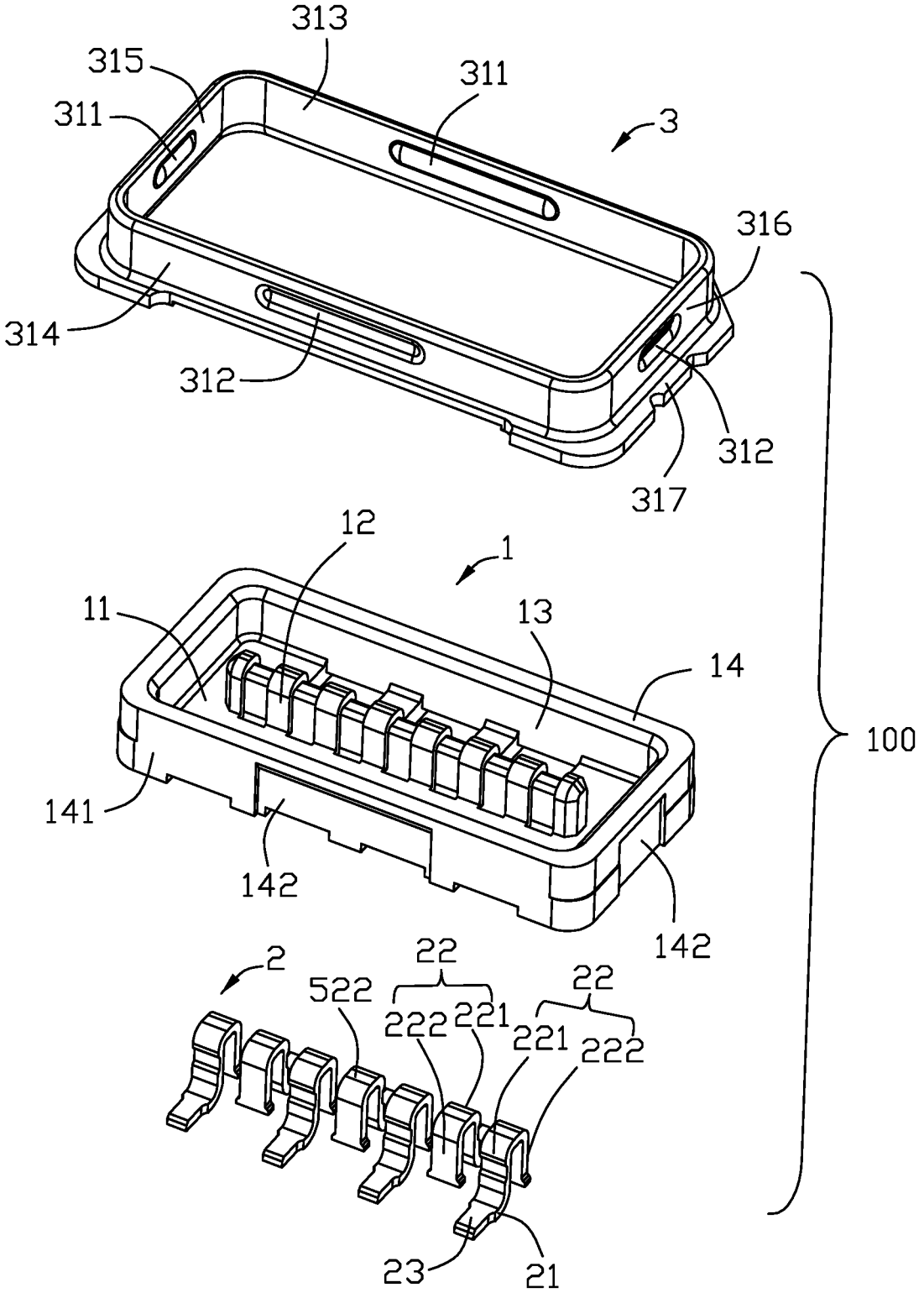
FIG. 4 is an exploded view of the plug connector.
Figure 5:
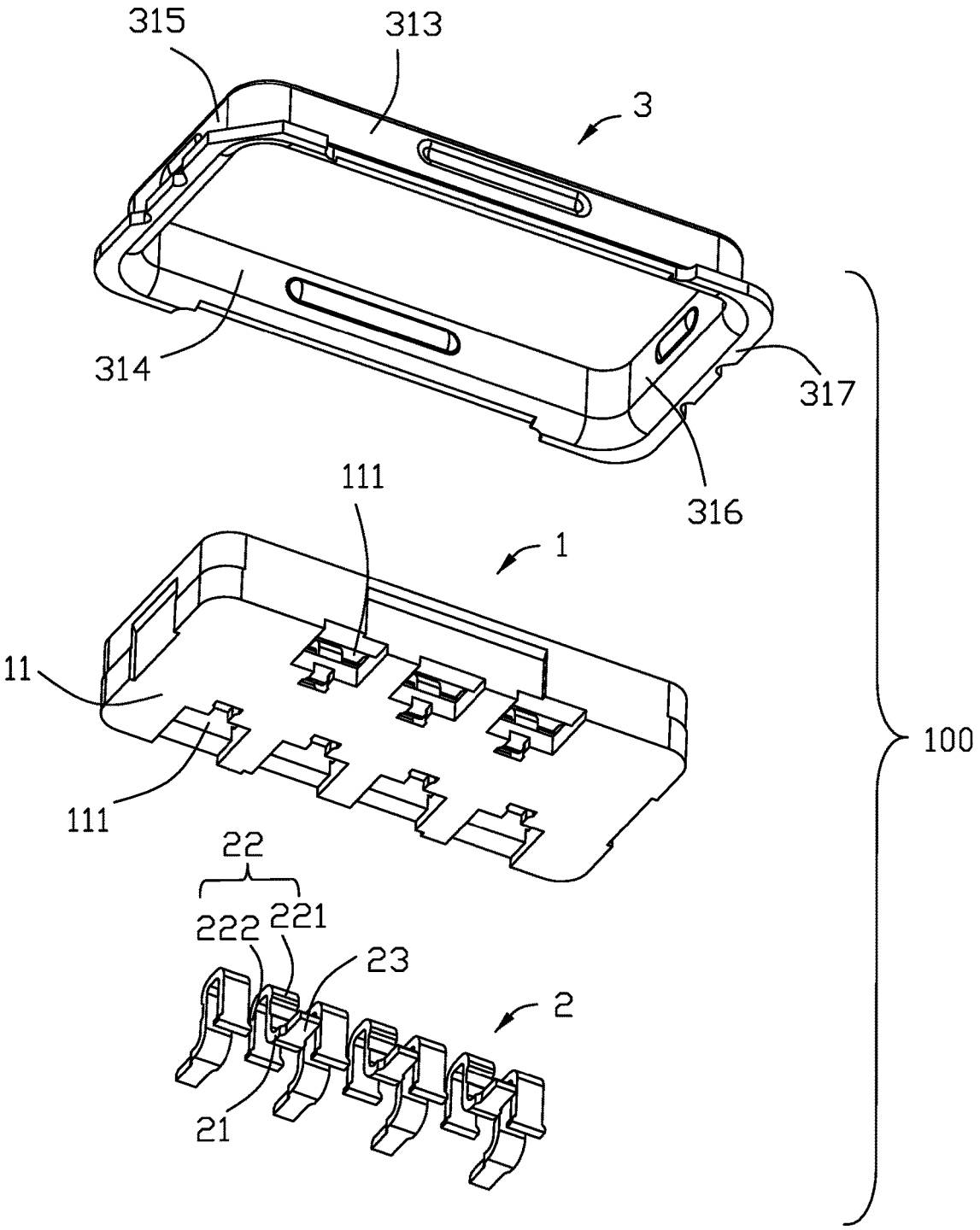
FIG. 5 is another exploded view of the plug connector.
Figure 6:
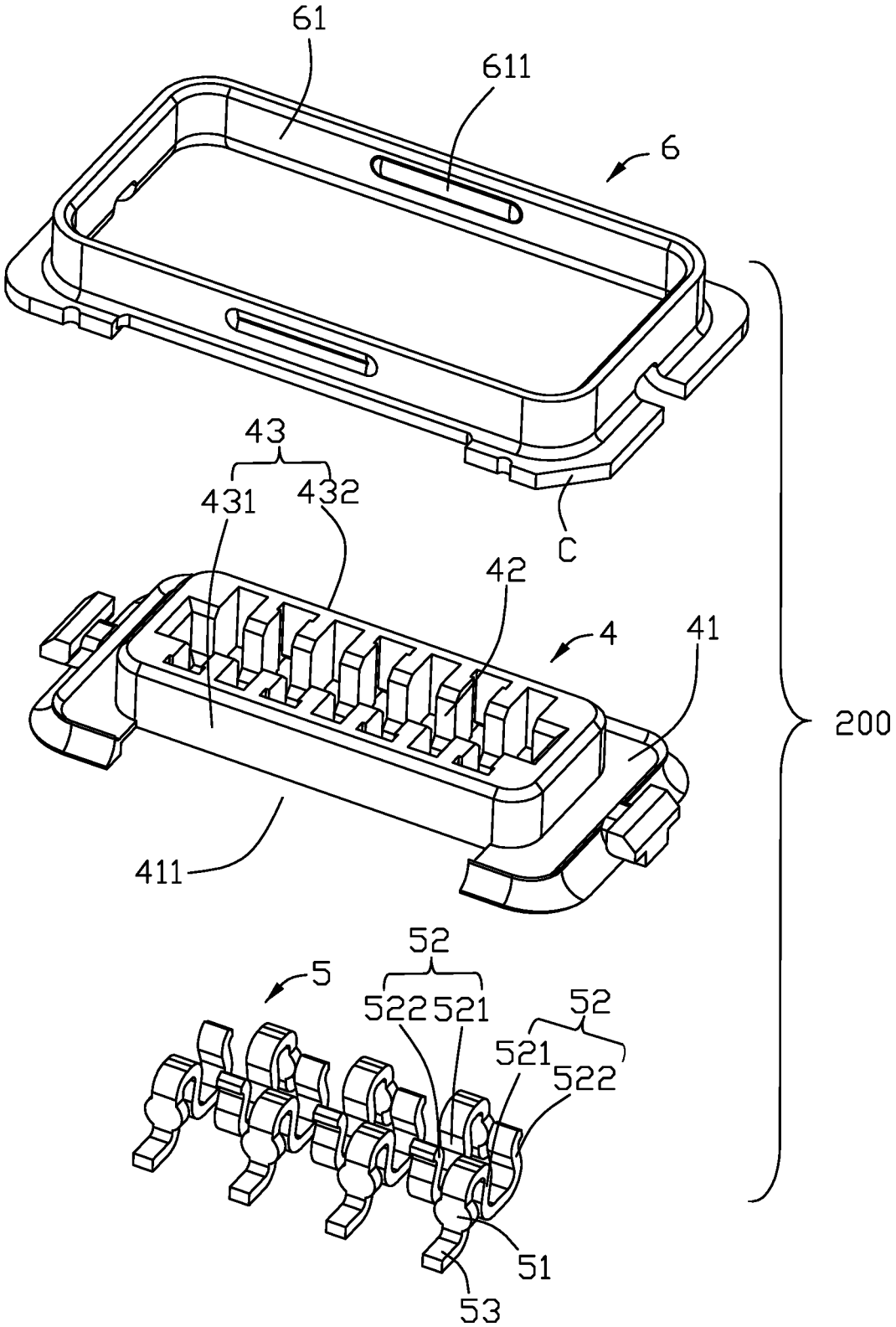
FIG. 6 is an exploded view of the receptacle connector.
Figure 7:
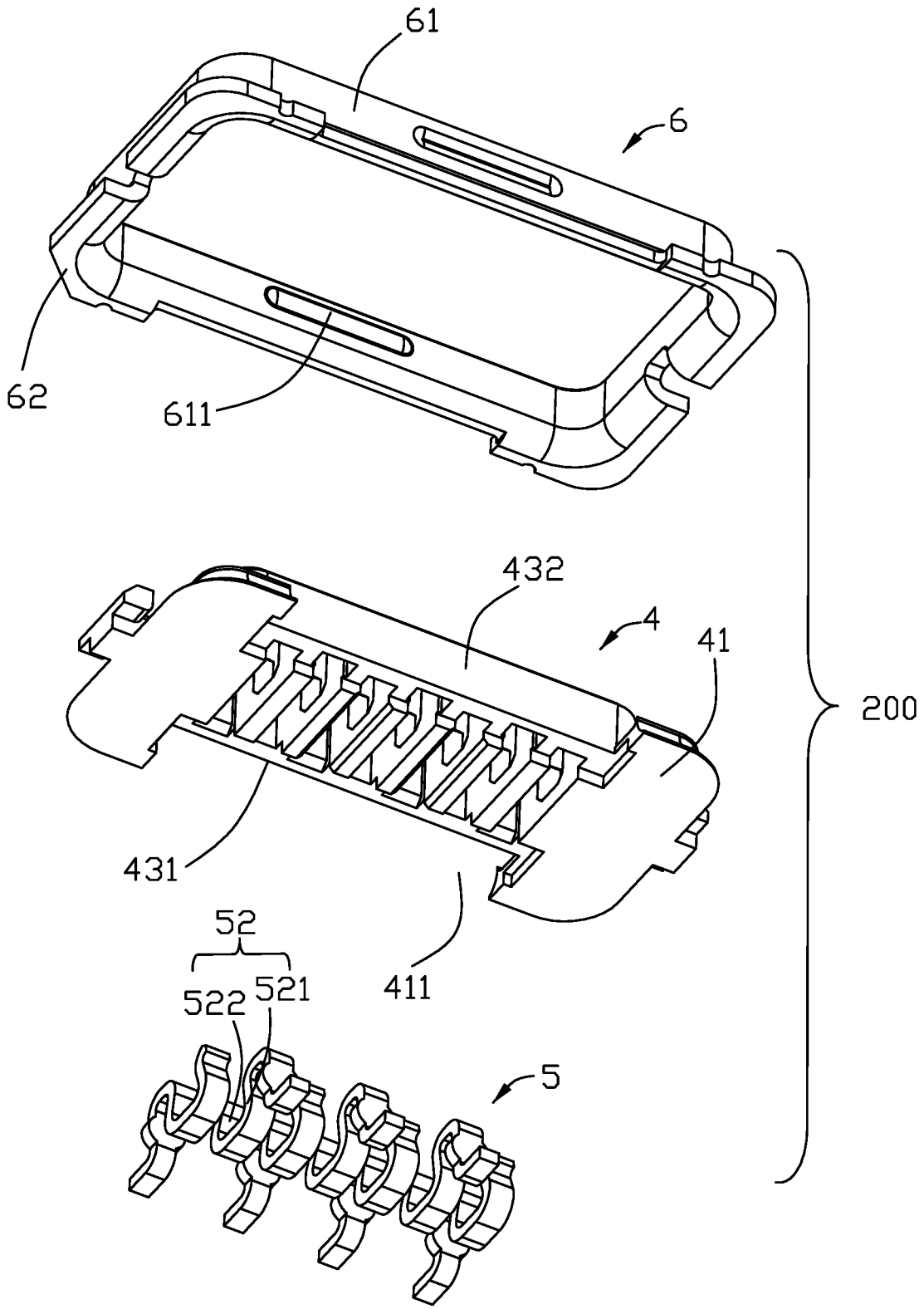
FIG. 7 is another exploded view of the receptacle connector.

Referring to FIGS. 1-3, an electrical connector assembly 100 includes a plug connector 100 for mounting on a printed circuit board (PCB) and a mating receptacle connector 200 for mounting on another PCB. The plug connector 100 includes an insulative (plug) housing 1, a plurality of (plug) contacts 2 secured to the insulative housing 1, and a (plug) shielding shell 3 enclosing the insulative housing 1. The receptacle connector 200 includes an insulative (receptacle) housing 4, a plurality of (receptacle) contacts 5 secured to the insulative housing 4, and a (receptacle) shielding shell 6 enclosing the insulative housing 4.

Referring to FIGS. 1 through 8, the plug connector housing 1 has a base 11, a tongue 12, a peripheral wall 14, and a groove 13. The contact 2 has a securing portion 21, a contacting portion 22, and a soldering tail 23. The shielding shell 3 has a seamless annular part 31 and a pair of soldering portions or horizontal seats 317. The insulative housing 1 has a plurality of peripheral recesses 142 and the shielding shell annular part 31 has a plurality of protrusions 311 for engaging the recesses 142. An outer surface of the shielding shell annular part 31 has a plurality of dimples 312.

Referring to FIGS. 1 through 11, the receptacle connector housing 4 has a base 41, a lip 43, and a groove 42. The contact 5 has a securing portion 51, a contacting portion 52, and a soldering tail 53. The shielding shell 6 has a seamless annular part 61 and a pair of soldering portions or horizontal plate 62. The shielding shell annular part 61 has a pair of protrusions 611 for engaging the dimples 312 of the plug shielding shell annular part 31 wherein the shielding shell annular part 61 is spaced from the lip 43 with a mating space 44 therebetween to receive the corresponding shielding shell annular part 31 and the associated peripheral wall 14 therein.

For effective shielding, the soldering tails 23 of the single row of contacts 2 are arranged alternately in two rows within an outer profile of the shielding shell annular part 31. Similarly, the soldering tails 53 of the single row of contacts 5 are arranged alternately in two rows within an outer profile of the shielding shell annular part 61. This arrangement also minimizes a size of the electrical connector.

The base 11 of the plug housing 1 has a plurality of windows 111 exposing the two rows of soldering tails 23. The contacting portion 22 of the contact 2 has a first part 221 and a second part 222. The first part 221 has a notch 2211. The shielding shell annular part 31 has opposite first and second side walls 313 and 314 and opposite third and fourth side walls 315 and 316. The lip 43 of the receptacle connector housing 4 has opposite first and second side walls 431 and 432. The base 41 of the receptacle connector housing 4 has a pair of windows 411 exposing the two rows of soldering tails 53. The contacting portion 52 of the contact 5 has a first part 521 and a second part 522.

Figure 8:
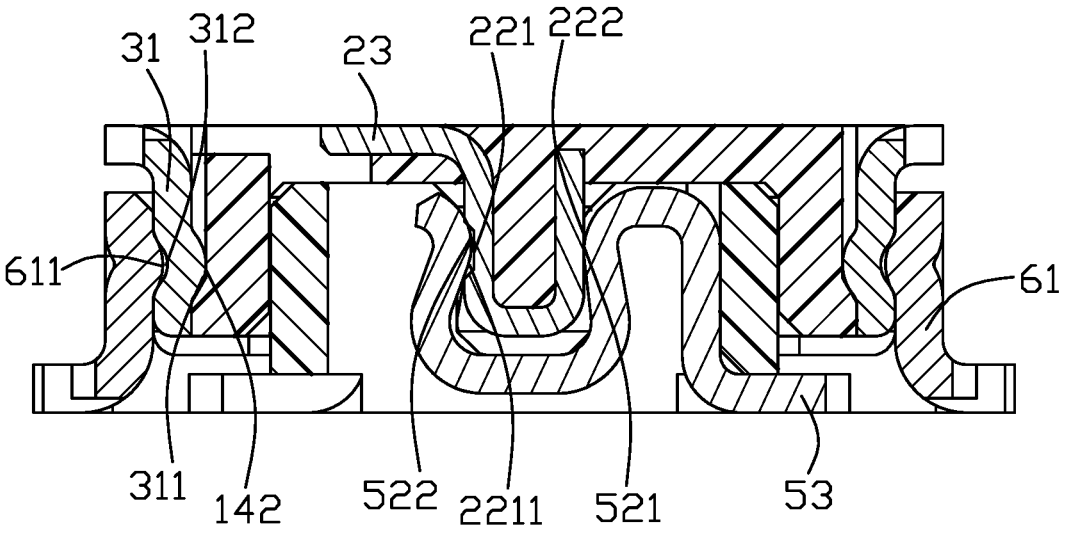
FIG. 8 is a cross-sectional view of the electrical connector assembly taken along line A-A in FIG. 1.

In brief, the seamless structure of the shielding shell may be obtained by the metal drawing process or metal injection molding process wherein the formal may keep the constant thickness while the latter may own different thicknesses at different positions. Notably, the contacts 2 as well as the contacts 5, are arranged with opposite orientations alternately, i.e, the soldering portions being alternately disposed on two opposite sides of the tongue. It is noted that as shown in FIG. 8, for the mated/paired contact 2 and contact 5, the soldering 23 of the contact 2 and the soldering tail 53 of the contact 5 are located at opposite sides of the longitudinal centerline (not labeled) or the tongue 12 in the transverse direction. Such an arrangement may provide more symmetrical structures mechanically and electrically. In this embodiment, the orientation identification mechanism is the chamfered corner C on the horizontal seat/solder portion of each connector so as to assure the respective connectors are correctly mounted/oriented upon the corresponding printed circuit board. In this embodiment, in the plug connector 100, the plug housing 1 and the plug contacts 2 are insert-molded together and the plug shielding shell 3 is attached to the plug housing 1, while in the receptacle connector 200, the receptacle housing 4 is integrally formed with the receptacle shielding shell 5 and the plug contacts 5 are secured to the receptacle housing 4.

What is claimed is:

1. An electrical connector assembly comprising:

a plug connector and a receptacle connector configured to be adapted for mating with each other, said plug connector including:

an insulative plug housing enclosed in a metallic plug shielding shell and including a horizontal base with a vertical mating tongue surrounded by a vertical peripheral wall with a vertical annular groove therebetween, said peripheral wall being fully circumferentially enclosed by the plug shielding shell;

one row of plug contacts secured to the plug housing along a longitudinal direction, each of said plug contacts including a contacting portion positioned upon the mating tongue, a soldering portion exposed under the base, and a securing portion located between the contacting portion and the soldering portion and retained to the housing;

said receptacle connector including:

an insulative receptacle housing enclosed in a metallic receptacle shielding shell and including a horizontal base with a vertical lip having a groove therein;

one row of receptacle contacts secured to the receptacle housing along the longitudinal direction, each of said receptacle contacts including a contacting section disposed in the groove, a soldering section located under the base, and a securing section located between the contacting section and the soldering section and retained to the housing; wherein said plug contacts are arranged with opposite orientations alternately and said receptacle contacts are arranged with opposite orientations alternately; wherein in each coupled/paired plug contact and receptacle contact, the soldering portion of the plug contact and the soldering section of the receptacle contact are located by opposite sides of the mating tongue, viewed along said longitudinal direction.

2. The electrical connector assembly as claimed in claim 1, wherein the plug shielding shell includes an annular portion intimately enclosing the peripheral wall, and a horizontal seat with a plug chamfered structure, and the receptacle shielding shell includes an annular section distantly enclosing the lip, and a horizontal plate with a receptacle chamfered structure which is aligned with the plug chamfered structure during mating.

3. The electrical connector assembly as claimed in claim 2, wherein a mating space is formed between the lip and the receptacle shielding shell for receiving the peripheral wall and the plug shielding shell therein.

4. The electrical connector assembly as claimed in claim 1, wherein the plug housing forms a plurality of windows in which the corresponding soldering portions are exposed, respectively.

5. The electrical connector assembly as claimed in claim 1, wherein the receptacle housing forms a pair of windows to expose the corresponding soldering sections therein.

6. The electrical connector assembly as claimed in claim 1, wherein both said plug shielding shell and said receptacle shielding shell are fully seamlessly circumferential.

7. The electrical connector assembly as claimed in claim 1, wherein in the plug connector, the plug housing is integrally formed with the plug contacts while the plug shielding shell is attached to the plug housing separately; in the receptacle connector, the receptacle housing is integrally formed with the receptacle shielding shell while the receptacle contacts are attached to the receptacle housing separately.

8. The electrical connector assembly as claimed in claim 1, wherein the peripheral wall forms a plurality of peripheral recesses, and the plug shielding shell forms a plurality of inward dimples respectively engaged within the corresponding recesses, and the receptacle shielding shell includes a plurality of protrusions engaged with within the corresponding dimples, respectively.

* * * * *